United States Patent [19]

Le Bret et al.

[11] Patent Number: 4,781,301

[45] Date of Patent: Nov. 1, 1988

[54] PROCESS OF FABRICATION OF DRUM BODIES HAVING ROLLING HOOPS AND THE DRUM BODIES SO PRODUCED

[75] Inventors: Lucien F. Le Bret, Saint-Gratien; Robert Saada, Maisons-Alfort, both of France

[73] Assignee: Gallay S.A., Gennevilliers, France

[21] Appl. No.: 77,847

[22] Filed: Jul. 27, 1987

[30] Foreign Application Priority Data

Aug. 5, 1986 [FR] France ..... 8611304

[51] Int. Cl.[4] ..... B65D 51/26

[52] U.S. Cl. ..... 220/72; 220/5 R; 220/DIG. 1

[58] Field of Search ..... 220/72, 5 R, DIG. 1; 72/367

[56] References Cited

U.S. PATENT DOCUMENTS

| | | | |
|---|---|---|---|
| 1,643,252 | 9/1927 | McCresy | 220/DIG. 1 X |
| 1,649,292 | 11/1927 | Draper | 220/72 |
| 3,198,374 | 8/1965 | Lindner et al. | 220/72 X |
| 3,472,418 | 10/1969 | Ullman | 220/72 |
| 3,949,877 | 4/1976 | Santoni | 220/72 X |
| 4,264,017 | 4/1981 | Karas et al. | 220/72 X |
| 4,538,439 | 9/1985 | Frei | 220/72 X |

*Primary Examiner*—Steven M. Pollard

*Attorney, Agent, or Firm*—Pennie & Edmonds

[57] ABSTRACT

The present invention relates to a process of fabrication of drum bodies having rolling hoops, and the drum bodies so produced. The drum body is provided with a plurality of corrugations generally offset towards the center of the drum with the peaks of the corrugations in line with the undeformed part of the drum. At least one of the peaks of the corrugations is then expanded radially outwardly to make a rolling hoop.

13 Claims, 3 Drawing Sheets

FIG. 1
PRIOR ART
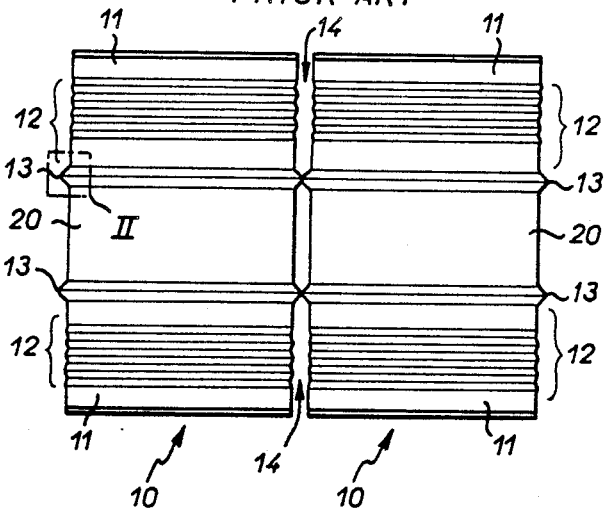
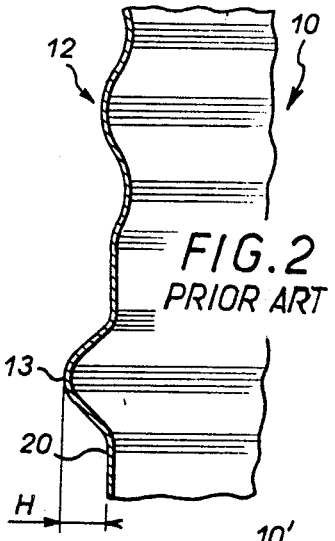
FIG. 2
PRIOR ART
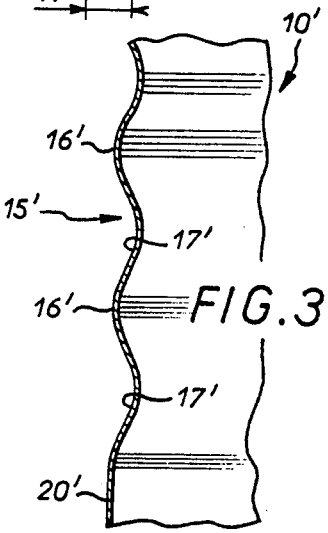
FIG. 3
FIG. 5
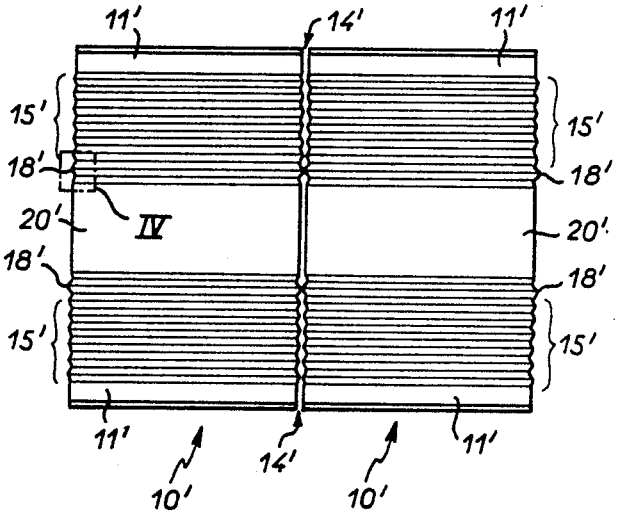

PROCESS OF FABRICATION OF DRUM BODIES HAVING ROLLING HOOPS AND THE DRUM BODIES SO PRODUCED

BACKGROUND OF THE INVENTION

The present invention relates to drum bodies with rolling hoops and the process of fabrication of such drum bodies. The drums are provided with at least two rolling hoops, allowing their handling by rolling on a surface, the drum being supported by the rolling hoops.

Drum bodies having at least two rolling hoops with outer diameter greater than that of the drum are already known. These hoops have two main functions, they permit the rolling on a surface of the drum, and they reinforce the structure of the drum by increasing its mechanical strength. Indeed, such a drum must be able to withstand possible deformation or implosion following an impact or contraction due to the heat drop of a product fed into the drum when hot, for example.

However, given that the outer diameter of the hoops is greater than the outer diameter of the drum, such hoops increase the radial bulkiness of the drums. This is a serious inconvenience, especially in the case of the standard 55 gallon drums used worldwide with a capacity of 216.5 liters and a radial spatial requirement standardized at 595±3 mm. The ISO containers which may be used to transport these drums have standard dimensions which are not tailored to accommodate drums. In such situations it is only possible to place three drums with rolling hoops and not four such drums side by side along the width of the container measuring 2334 mm. In these circumstances the container capacity is not used efficiently, the volume being just too small to accommodate a fourth drum. The economy of operation of transporting drums under such conditions is seriously questioned.

Drums provided with depressed corrugations are already known, for example U.S. Pat. No. 1,649,292. The drum disclosed in this patent has corrugations formed within the original diameter of the drum. This drum also has two expanded rolling hoops, adjacent to the corrugations and extending outwards from the drum. The corrugations are intended to reinforce the drum structure in case of shocks. The drum of the U.S. Pat. No. 1,649,292 does not provide a solution to the need to reduce the radial spatial requirement of such drums, since it includes the two widely protruding rolling hoops.

Also, in the German language PCT Application No. WO 85/01714 drums showing different configurations of corrugations are disclosed. As seen from this application the corrugations can be formed within the original diameter of the drum or outside the original diameter. Also, the corrugations can be formed with the peaks outside the diameter of the drum and the troughs inside the diameter. Different combinations of corrugations are shown. A conventional widening of the rolling hoops is disclosed to compensate reduced rolling hoop depth.

SUMMARY OF THE INVENTION

The present invention aims notably at mitigating the disadvantages and inconveniences of the prior art constructions by establishing a process of fabrication of drums having rolling hoops without appreciably increasing but offering the possibility of the radial spatial requirement over that of drums without rolling hoops.

The aim of the present invention is, therefore, to establish a process of fabrication of a drum having rolling hoops permitting the rolling of the drum and having uniform strength, while at the same time reducing the outside diameter of such hoops from the usual value of 595 mm to the critical value of one quarter of 2334 mm, that is about 583 mm, so rendering possible the arranging of four drums side by side along the breadth of an ISO standard container, the capacity of the drum remaining virtually unchanged.

The invention also provides a process of fabrication of drums provided with rolling hoops having the usual radial spatial requirement, and also having its rigidity and strength increased and uniformly distributed.

With the above objects, the present invention relates to a process of fabrication of drum bodies wherein the drum is provided with a plurality of corrugations comprising alternating peaks and troughs, these corrugations generally being offset towards the center of the drum. In addition to the inwardly formed corrugations, rolling hoops are formed by outwardly expanding the drum body from the center of the drum along a zone of a plurality of the corrugations. The zone comprises at least one peak between adjacent troughs of a corrugation such that the zone defines the required rolling hoop with an outer diameter greater than that of the drum.

It should be noted that the zone which is radially expanded outwards from the center of the drum to form the rolling hoop can be formed by just one of the peaks of the corrugations, or it can extend to the adjacent troughs or hollows or to adjacent peaks.

With the present invention, the radial spatial requirement of the drums is reduced over prior art constructions, and it therefore becomes possible to place drums in rows of four in a standard ISO container. It is to be noted that this reduction in the radial spatial requirement is achieved without changing the mechanical and rolling properties of the drums. With the present invention it is also possible to make the rolling hoops of the customary dimensions, but with a uniformly increased mechanical strength.

It should be noted that the same process of fabrication allows the making of rolling hoops having reduced radial spatial requirement and/or increased mechanical strength according to the stage at which the process of fabrication is halted. This is, of course, a very important advantage since the same machine can make several different types of rolling hoops representing substantial economy in the production of these rolling hoops.

BRIEF DESCRIPTION OF THE DRAWINGS

FIG. 1 is a front view representing two drums with standard rolling hoops placed side by side;

FIG. 2 is an enlarged view of the detail referenced II in FIG. 1;

FIG. 3 is a longitudinal section of the drum showing the first stage in formation of a drum having a rolling hoop according to the present invention;

FIG. 5 is a view similar to that of FIG. 1 showing two drums placed side by side and having rolling hoops with radial spatial requirement reduced according to the present invention;

DETAILED DESCRIPTION OF THE INVENTION

Figure 4A:
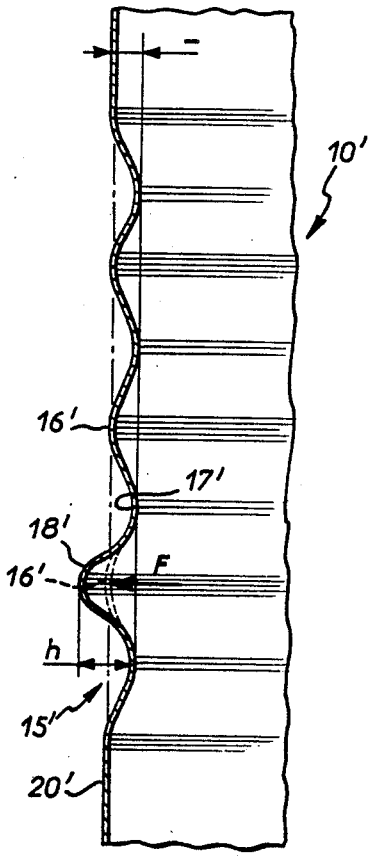
FIG. 4*a* is an enlarged view of the detail referenced IV in FIG. 5 and a second stage in the process of fabrication of a drum having a rolling hoop according to the invention.

A drum 10 of the standard type, FIGS. 1 and 2, consisting of a body 11, or side wall, provided with corrugations 12 and rolling hoops 13. Such a standard drum has two rolling hoops encompassing a central non-corrugated generally cylindrical part.

In FIG. 1, two standard drums are placed side by side and, as is noticed, the rolling hoops 13 of these drums give rise when they touch, to a gap 14 between the drums. This gap 14 constitutes an unusable volume, which hinders the placing side by side of four drums of this type in a container having standard dimensions.

The process of fabrication of drums having rolling hoops according to the invention is seen with reference to FIGS. 3 and 4*a*. Firstly, the side wall 11' of the drum is provided with depressed corrugations 15', made by deforming the wall 11'. These corrugations are formed towards the inside of the drum, the peaks 16' remain therefore in a line with the non-deformed parts of the cylindrical wall 11', the troughs 17' are depressed within the normal diameter of the wall.

Secondly, as shown in FIG. 4*a*, one of the peaks 16' between two troughs of the depressed corrugations is expanded mechanically in the direction of the arrow F away from the center of the drum, so creating a rolling hoop 18' according to the invention. It is to be noted that the peak 16' only has been deformed by expansion, and that this deformation is restricted to the immediate regions of the said peak.

It should be noted that the size H of a standard rolling hoop, as shown in FIG. 2, is almost or exactly equal to the size h of a rolling hoop according to the invention and as shown in FIG. 4*a*. However, the outward projection from the drum of the tip or peak of the rolling hoop 18' is less than that of the tip of the standard rolling hoop. Indeed, in the case of a standard drum, the hoop size H is measured with respect to the smooth non-deformed surface of the wall 20 of the drum, whereas the size h of the hoop according to the invention, is taken with reference to the bottom of the trough 17' of each of the corrugations surrounding said hoop. As described above, the trough 17' of these corrugations has been offset towards the center of the drum during the first stage of the process of fabrication. Consequently, even though the rolling hoop 18' presents a similar size to that of the standard rolling hoop, the outer diameter of the hoop according to the invention, and therefore its radial spatial requirement has been reduced. In addition, the size h is the same on both sides of the hoop. In this way, even though the radial spatial requirement of the hoop according to the invention is reduced, its strength is uniform and equivalent to that of hoops of the standard type. Also, it believed that the expansion of a peak actually renders it stronger than the prior art hoops. Thus, the rolling hoop of the invention is therefore stronger, and at the same time has a reduced radial spatial requirement.

Figure 4B:
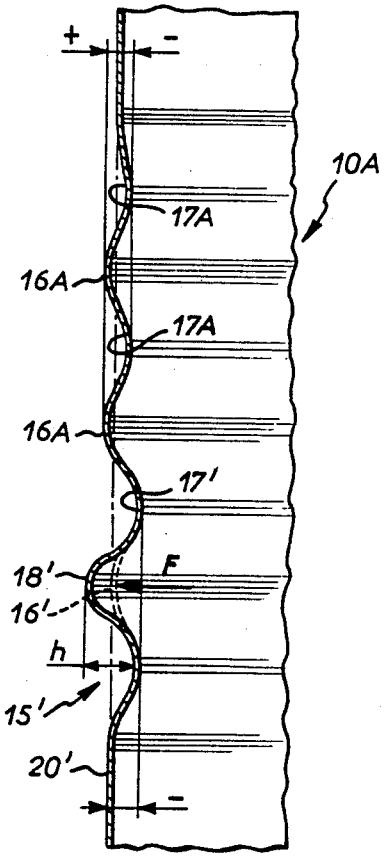
FIG. 4*b* is an enlarged view similar to FIG. 4*a* of an alternate embodiment of the present invention.

A further embodiment of the corrugations in the side wall of the container is illustrated in FIG. 4*b*. In this embodiment the peaks of the corrugations protrude slightly beyond the smooth surface parts 20' of the container side wall. The radial offset of the troughs 17A is equal to the radial offset of the peaks 16A relative to the smooth surface of the container side wall. The radial distance between the peaks 16A and the troughs 17A is substantially equal to that between the peaks 16' and the troughs 17' in the FIG. 4*a* embodiment. Thus, the mechanical properties of the corrugations 16A, 17A are virtually the same as those of FIG. 4*a*. The advantage of the FIG. 4*b* arrangement of the corrugations is that since the diameter of the peaks and troughs is greater than that of the embodiment of FIG. 4*a*, the volumetric capacity of the drum is slightly greater than that of the FIG. 4*a* embodiment.

It will be noticed that in the embodiment of FIG. 4*b*, the peak 16' and the adjoining troughs 17' in the zone of the rolling hoop 18' are identical in configuration and diameter to those of the FIG. 4*a* embodiment. In particular, the peak 16', shown in dashed lines, is in line with the smooth parts 20' of the container side wall. Thus, the radial height h of the rolling hoop 18' of both embodiments is the same as is the radial outer most dimension of the side walls of the respective drums. The only difference between the embodiments of FIGS. 4*a* and 4*b* is the position of the corrugations with respect to the smooth surface of the side wall of the drum.

Of course, the rolling hoop 18' according to the invention protrudes out from the drum wall 20' sufficiently to permit the rolling of the drum. However, as is clearly shown in FIG. 5, the space 14' between two drums according to the invention placed side by side is markedly reduced once the spacing with the prior art construction. Such a decrease in radial spatial requirement of the rolling hoops 18' provided on the drums allows the side by side placing of four such drums in an ISO container of standard dimensions.

Figure 7A:
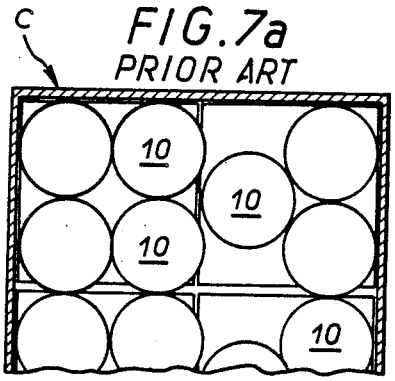
FIG. 7a PRIOR ART
FIGS. 7*a* and 7*b* are schematic top views of containers loaded with standard drums with rolling hoops.
Figure 7B:
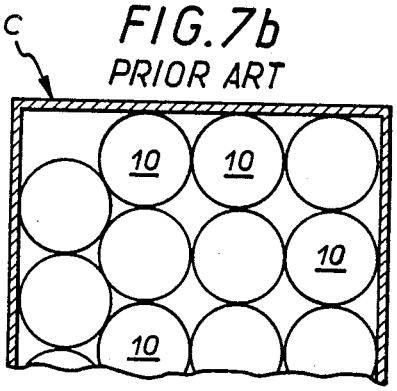
FIG. 7b PRIOR ART
Figure 7C:
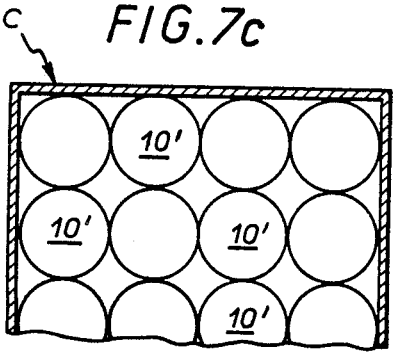
FIG. 7*c* is a similar view of a container loaded with drums according to the invention.

Indeed, as is clearly seen in FIGS. 7*a* and 7*b*, the drums 10 having standard dimensions cannot be placed side by side in rows of four along the width of a container C having standard dimensions because the outer maximum diameter of the standard drum as determined by the rolling hoops is too large. However, as is shown in FIG. 7*c*, the drums 10' according to the invention can be so placed four across without the capacity of the drums being appreciably altered.

It should be noted that the decrease in radial spatial requirement of the drums according to the invention also allows a better vertical stacking of the drums. This is so since the rolling hoops of two drums placed side by side do not tend, as is the case with drums of the standard type, to overlap or ride upon one another. Also, the free space 14' between the drums is reduced. Therefore, even if there is overlapping of the hoops it will not result in any appreciable displacement of the drums with respect to each other.

Figure 6:
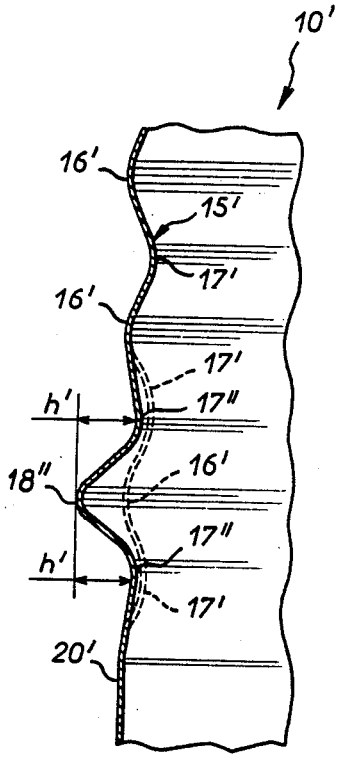
FIG. 6 is a similar view to that of FIG. 4 showing an alternative mode of the process of fabricating a drum with rolling hoops having conventional spatial requirements but enhanced mechanical strength.

As shown in FIG. 6, the process of fabrication described above can be continued such that the peak of the expanded zone 18'' presents an outer diameter identical to that of standard rolling hoops. In this case, the troughs 17'' on either side of the peak 18'' are also slightly displaced away from the drum center compared with the position 17' occupied initially. The aim of this fabrication process is no longer to reduce the radial spatial requirement of the hoops, but to reinforce uniformly their strength. Indeed, the expansion of the peak 18'' has the marked consequence of conferring an increased resistance to radial stresses exerted on the drum body. Indeed, the rolling hoop realized in this way presents a hoop size h' distinctly greater than the size H of standard rolling hoops, even though the outer diameter of such a rolling hoop is the same as that of a standard hoop.

The radially outwardly expanded zone can extend not only to the adjacent troughs, but to the adjacent peaks. In this way the size and strength of the rolling hoops can be further increased.

It should be noted that the fabrication process according to the invention offers the possibility of deforming just the peak of the corrugation or again the possibility of extending the deformation to adjacent troughs or adjacent peaks; the rolling hoop formed in this way presenting notably different features. The advantage of such a process makes possible the use of one machine for the fabrication of three different types of rolling hoops.

Of course, the present invention is not limited to the preferred embodiments herein described. It encompasses variations, as for example, a standard drum fitted with more than two hoops according to the invention. It is also possible to vary the extent of the corrugated zone. Indeed it is possible to cover the whole drum wall with corrugations. It is also possible to provide on either side of a corrugated zone according to the invention zones having standard type corrugations with peaks projecting beyond the normal drum diameter.

What is claimed:

1. A process of fabrication of drum bodies having rolling hoops and a smooth cylindrical surface, the process comprising:

(a) forming a plurality of corrugations on the smooth cylindrical outer surface of the drum, the corrugations comprising alternating circumferentially extending peaks and troughs, the troughs being offset towards the axis of the drum, at least one of the peaks having a diameter equal to that of the smooth surface; and (b) radially outwardly expanding a zone comprising said one peak between two immediately adjacent troughs and defining a rolling hoop having an outer diameter greater than that of the smooth surface of the drum and that of the other peaks.

2. The process according to claim 1, wherein the zone outwardly expanded from the center of the drum is formed solely by deforming the immediate regions of said peak.

3. A process according to claim 1, wherein the zone outwardly expanded from the center of the drum is formed by deforming said peak and the immediately adjacent troughs, on either side thereof.

4. A process according to claim 1, wherein the peaks, other than said one peak as expanded, are radially outwardly offset from the smooth surface a distance substantially equal the distance the troughs, other than the troughs immediately adjacent said one peak, are radially inwardly offset towards the axis of the drum from the smooth surface.

5. A process according to claim 1, wherein the depth of the troughs adjacent said one radially expanded peak in relation to the diameter of the smooth surface is greater than that of the other troughs in relation to the diameter of the smooth surface.

6. A process according to claim 1, wherein the corrugations are formed so that all the peaks have a diameter equal to that of the smooth surface.

7. A process according to claim 1, wherein all the troughs have the same diameter.

8. In a drum body having a smooth cylindrical surface for part of its height and at least two rolling hoops, the improvement comprising:

(a) at least one set of a plurality of corrugations comprising alternating peaks and troughs, the diameter of the troughs being less than that of the smooth surface and at least two peaks having a diameter equal to that of the smooth surface, the other peaks having a diameter equal to or greater than that of the smooth surface; and (b) each rolling hoop being positioned between two immediately adjacent troughs and being defined by an expanded one of the at least two peaks, said rolling hoop protruding radially outwardly with respect to the other peaks.

9. A drum body according to claim 8, wherein the other peaks have a diameter slightly greater than that of the smooth surface and the troughs have a diameter slightly less than that of the smooth surface, the troughs immediately adjacent the rolling hoops being deeper than the other troughs.

10. A drum body according to claim 9, wherein the other peaks and the other troughs respectively are radially outwardly and inwardly offset relative to the smooth surface by equal distances.

11. A drum body according to claim 8, wherein the other peaks have a diameter equal to that of the smooth surface and the troughs immediately adjacent the rolling hoops have the same diameter as the other troughs.

12. A drum body according to claim 8, wherein each rolling hoop is comprised solely of the immediate regions of the corresponding one of the two radially expanded peaks.

13. A drum body according to claim 8, wherein each rolling hoop extends into the troughs immediately adjacent the rolling hoop.

* * * * *